US005522575A

United States Patent [19]

Volz

[11] Patent Number: 5,522,575

[45] Date of Patent: Jun. 4, 1996

[54] SERVO CASE AND MOUNTING FIXTURE THEREFOR

[76] Inventor: Michael A. Volz, Altkönigstrasse 9, D-60323 Frankfurt, Germany

[21] Appl. No.: 310,049

[22] Filed: Sep. 21, 1994

[30] Foreign Application Priority Data

Sep. 23, 1993 [DE] Germany ..... 9314366 U

[51] Int. Cl.[6] ..... G12B 9/00

[52] U.S. Cl. ..... 248/27.1; 446/57

[58] Field of Search ..... 248/27.1, 27.3, 248/544, 205.1; 335/132; 446/57

[56] References Cited

U.S. PATENT DOCUMENTS 3,784,174 1/1974 Tarnofsky ..... 446/57 X
4,160,253 7/1979 Mabuchi et al. ..... 343/225
4,879,437 11/1989 Dard et al. ..... 335/132 X
5,078,638 1/1992 Molina ..... 446/57
5,383,810 1/1995 Loving ..... 446/57

*Primary Examiner*—Ramon O. Ramirez
*Attorney, Agent, or Firm*—Collard & Roe

[57] ABSTRACT

A servo case and a mounting fixture for an actuator servo used for radio-controlled models. The mounting fixture is a molded frame which houses the servo case. The mounting frame is usually permanently mounted to the model. In airplanes, the frames are typically mounted within the interior of the wing. The servo contains removable tabs for the horizontal or vertical mounting of the servo, so that it can be removably attached to the fixture. This allows the servo case to be quickly snapped into the mounting frame, and likewise snapped out of the mounting frame when it has to be serviced.

6 Claims, 2 Drawing Sheets

SERVO CASE AND MOUNTING FIXTURE THEREFOR

BACKGROUND OF THE INVENTION

1. Field of the Invention

The present invention relates to a servo case and a mounting fixture or bracket for a servo used for radio controlled models.

2. The Prior Art

Servos are used as actuators for flight control surfaces on radio models such as aircraft, helicopters and cars. Conventional servo cases or housings are box-shaped, and have two mounting tabs with predrilled holes for mounting the servos in a vertical position. There are also servo cases that have mounting tabs for mounting the servos horizontally, but these are very rare. In order to eliminate any backlash between the servo and the rudder, and to obtain a smooth, free moving motion from the servo arm to the control surface, it had become popular to install servos directly where they were needed (i.e., directly in the wings or rudders of a plane). Because of the relatively narrow thickness of the wings and rudders, servos have to be installed in a horizontal position, thus mounting the servo on its side.

When a conventional servo is installed in the horizonal, flat position, as mentioned above, the mounting tabs on the servo case require that a hole be cut that is much larger than the servo case itself. In most wings, all the structures within a wing are integral parts which add to the structural integrity of the entire wing. Therefore, in almost all cases, when a larger hole is cut for the servo, the structure of the wing or rudder is weakened at that particular point. For this reason, servos have been developed that do not have any mounting tabs (or the mounting tabs are cut off of conventional servos) and are used exclusively for wing or rudder installations. Although this type of servo has minimized the size needed to cut out the wing or rudder, these servos are very difficult to install in a vertical position, due to the lack of mounting tabs.

SUMMARY OF THE INVENTION

It is therefore an object of the present invention to provide a servo which will perform three separate functions equally:

1. to provide a servo that can be mounted horizontally with a minimum size hole cut in the wing or rudder.
2. to provide a mounting for the servo in a fixed frame that allows for easy access and removal, and
3. to be able to mount the servo standing vertically with the use of mounting tabs.

The above objects are achieved according to the present invention because of the following features:

1. The servo has removable mounting tabs. This feature reduces the outside perimeter of the servo's case when it is mounted horizontally, but allows for mounting tabs when it stands vertically. One or more detachable mounting tabs can be fixed onto the servo case or removed, depending on the application.

2. The servo case has recesses for receiving removable mounting tabs.

3. There are provided locking tabs on the servo case that snap into corresponding holes in the fixation frame in order to attach the servo to the mounting frame.

4. The system has a fixation frame that makes it easy to mount the servo horizontally without permanently gluing it in. The servo is easy to remove from the fixed frame. The locking tabs on the sides of the servo case snap into the related counterparts in the fixed frame. A knife or screwdriver can be inserted in between the servo and the frame to widen the frame's sides to allow for its easy removal.

BRIEF DESCRIPTION OF THE DRAWINGS

Other objects and features of the present invention will become apparent from the following detailed description considered in connection with the accompanying drawings which disclose the embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
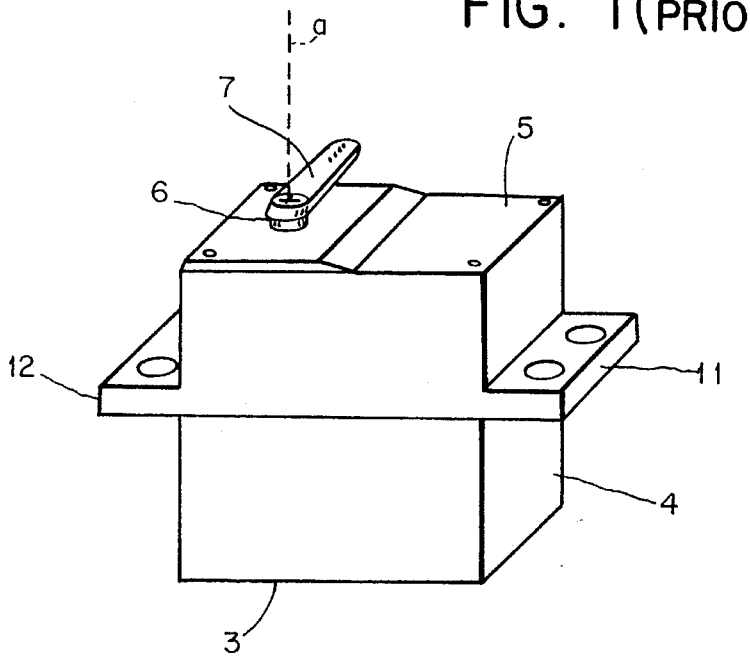
FIG. 1 (PRIOR ART)
FIG. 1 shows a conventional servo with mounting tabs for installing the servo so that it stands vertically.

Turning now in detail to the drawings, FIG. 1 shows a conventional servo with mounting tabs for installing the servo so that it stands vertically. The complete servo case 3 consists of a bottom 4 and a top 5, with permanent mounting tabs 11 and 12. There is a hole 6 surrounding the main output shaft which rotates a servo arm 7 on a perpendicular axis a.

Figure 2:
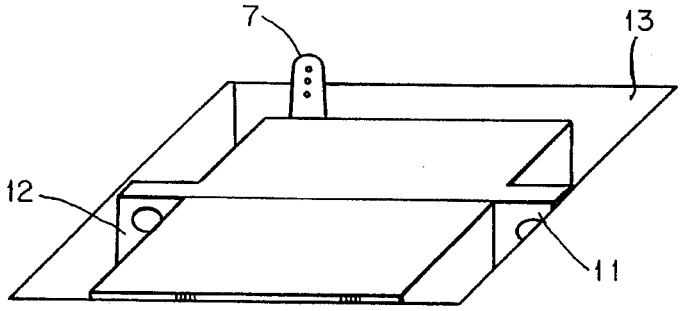
FIG. 2 (PRIOR ART)
FIG. 2 shows the same servo as in FIG. 1 in the horizontal position with the hole that has been cut out for installing the servo.

FIG. 2 shows a conventional servo as in FIG. 1, mounted horizontally, with a hole 13 that has been cut out for installing the servo. Mounting tabs 11 and 12 are part of the servo case and, therefore, the hole has to be cut much larger than it would have been for just the case of the servo, as in FIG. 3.

Figure 3:
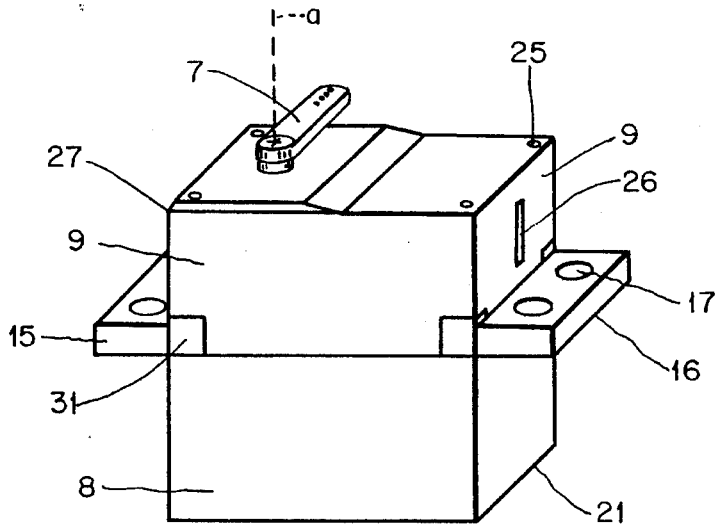
FIG. 3 shows a servo according to the invention that has the detachable mounting tabs for vertical applications and with locking tabs on both sides of the top part of the case for attaching the servo to the mounting frame.

FIG. 3 shows the new design for the servo that has the detachable mounting tabs 15 and 16 for vertical applications and with locking tabs 26 and 27 on both sides of the top part of the case for attaching the servo to the mounting frame. Four servo case screws 22, 23, 24 and 25 not only hold top 9 and bottom 8 of the case together, but keep the detachable mounting tabs in their recesses 31, 32, 33 and 34.

Figure 4:
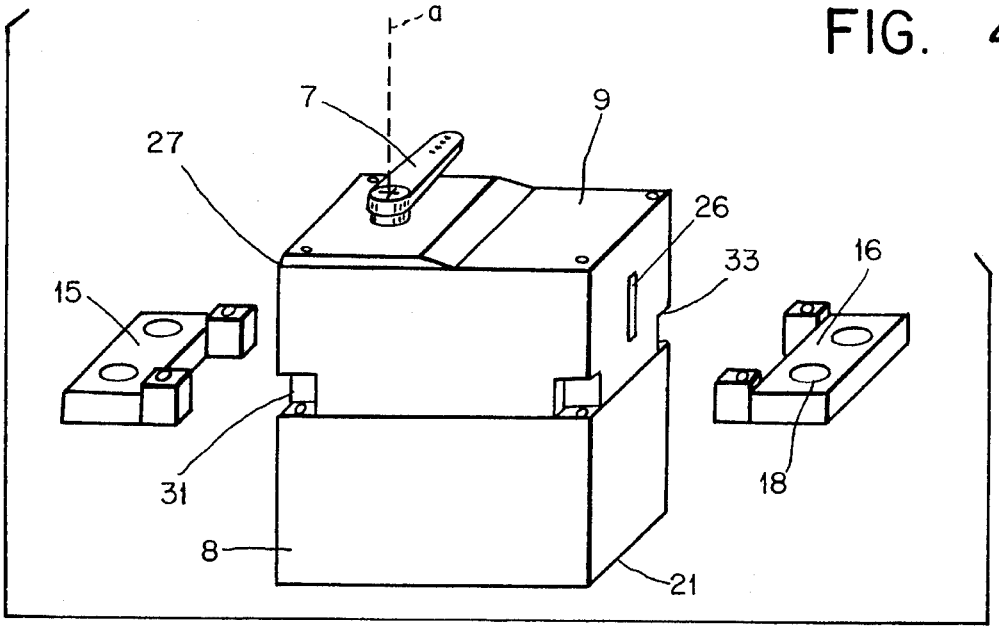
FIG. 4 shows the servo of FIG. 3, after the detachable mounting tabs have been removed.

FIG. 4 shows the same servo as in FIG. 3 after the detachable mounting tabs 15 and 16 have been removed. For detaching the mounting tabs, servo case screws 22, 23, 24 and 25 have to be unscrewed, the detachable mounts removed, and the screws reinstalled.

Figure 5:
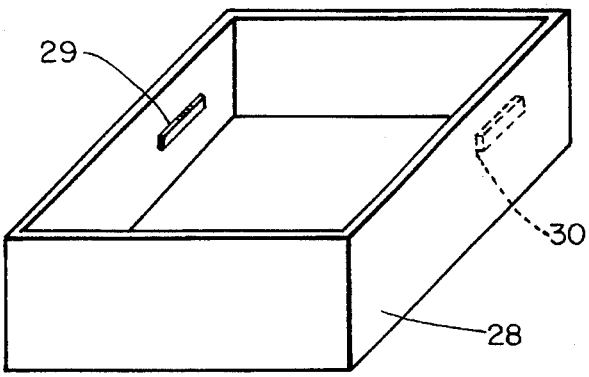
FIG. 5 shows the fixation frame with slots for receiving the locking tabs of the servo.

FIG. 5 shows fixation or rigid frame 28 with slots 29 and 30 for fixing the servo through locking tab 26 and 27. Whenever the servo is pressed into the frame, the sides of the flexible frame will widen slightly to allow the tabs to snap into the slots.

Figure 6:
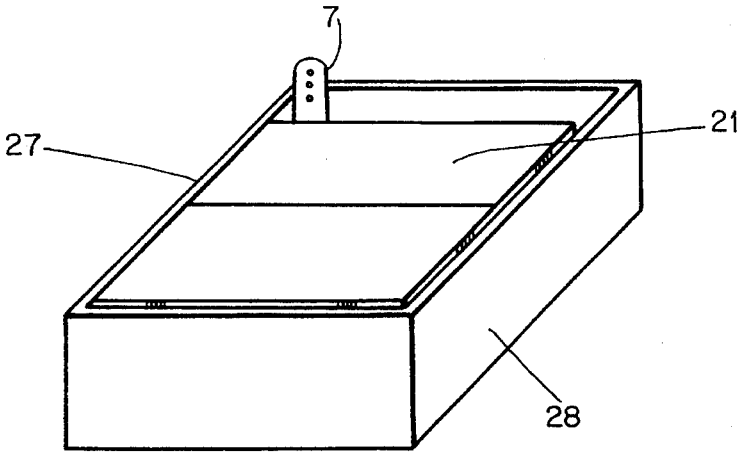
FIG. 6 shows the fixation frame with the servo case disposed inside of it.

FIG. 6 shows the fixation frame 28 with the servo case 21 disposed inside of it. Here, the locking tabs are captured within corresponding slots 26, 29 and 27, 30 in the frame.

Case 21 for the servo has mounting tabs and a fixation frame 28 that surrounds the servo case and is fixed in the model by one or more detachable mounting tabs 15 and 16 that can be screwed into the recess in servo case 31, 32, 33 and 34. The servo also has one or more locking tabs 26 and 27 that can either be put on the sides of the servo case 21 or are part of the injection mold. The locking tabs will keep the servo case in position whenever it is put into the fixation frame and they snap into slots 29 and 30.

The case for the servo, as described above, has detachable mountings 15 and 16 and has holes or recesses 17, 18, 19 and 20 for the attachment screws, rivets or bolts to mount the servo in the vertical position. The case for the servo is defined by detachable mountings 15 and 16 that can be screwed onto servo case 21, or be plugged into corresponding recesses 32, 32, 33 and 34 in the servo case. The case for the servo has detachable mountings 15 and 16 that are kept in position by screws 22, 23, 24 and 25 that keep the entire servo case together.

Servo case 21 has locking tabs 26 and 27 that have been injected molded on at least one side of the case, preferably two corresponding sides of the servo.

Fixation frame 28 has slots 29 and 30 on at least one side, preferably two sides, of the fixation frame that correspond, with the locking tabs 26, 27 on the servo case and snap into place when the servo is put into the frame.

While only two embodiments of the present invention have been shown and described, it is to be understood that many changes and modifications may be made thereunto without departing from the spirit and scope of the invention as defined in the appended claims.

What is claimed is:

1. A case for a servo that is coupled to the receiver of a radio-controlled model, with a mounting and fixation frame surrounding the servo case, the frame being affixed to the model, comprising:

recess means formed into the sides of the servo case;

at least one detachable mounting disposed on the servo case that can be detachably mounted into said recess means on the servo case;

said fixation frame having corresponding openings; and plug means disposed on the sides of said servo case for detachable insertion into the corresponding openings of the fixation frame.

2. The case as claimed in claim 1, wherein said at least one detachable mounting has holes or recesses for receiving attachment screws, rivets or bolts in a substantially perpendicular position.

3. The case as claimed in claim 2, wherein said at least one detachable mounting is locked into position by those screws that join together the entire servo case.

4. The case as claimed in claim 1, wherein said plug means are injection-molded on at least one side of the servo case, and are inserted into the corresponding openings of the fixation frame so as to secure the servo case to the frame.

5. The case as claimed in claim 1, wherein the sides of the servo case include slots, and said plug means can be detachably secured to said slots.

6. The case as claimed in claim 1, wherein recesses on at least one side of the fixation frame receive plug means of the servo case when the servo case is put into the fixation frame.

* * * * *